US005343849A

United States Patent [19]

Steer

[11] Patent Number: 5,343,849

[45] Date of Patent: Sep. 6, 1994

[54] RAPID FIRE BALL GUN

[76] Inventor: Michael Steer, 416 W. Huron, Ann Arbor, Mich. 48103

[21] Appl. No.: 930,634

[22] Filed: Aug. 17, 1992

[51] Int. Cl.[5] ..... F41B 11/26; F41B 11/32

[52] U.S. Cl. ..... 124/72; 124/69

[58] Field of Search ..... 124/56, 63–67, 124/69–74, 83, 45

[56] References Cited

U.S. PATENT DOCUMENTS

| | | | |
|---|---|---|---|
| 2,601,555 | 6/1952 | Pope | 124/65 |
| 2,630,108 | 3/1953 | White | 124/65 |
| 2,653,593 | 9/1953 | Foster | 124/65 |
| 2,725,868 | 12/1955 | Foster . | |
| 2,725,869 | 12/1955 | Barber | 124/65 |
| 2,729,207 | 1/1956 | Foster | 124/65 |
| 2,749,902 | 6/1956 | Foster | 124/65 |
| 2,762,356 | 9/1956 | Foster | 124/65 |
| 2,762,357 | 9/1956 | Foster | 124/65 |
| 3,342,171 | 9/1967 | Ryan et al. | 124/55 |
| 3,633,560 | 1/1972 | DeFreitas | 124/56 |
| 3,765,396 | 10/1973 | Kienholtz et al. . | |
| 3,783,737 | 1/1974 | Ashley | 89/7 |
| 4,086,902 | 5/1978 | Reynolds | 124/61 |
| 4,159,705 | 7/1979 | Jacoby | 124/63 |
| 4,163,439 | 8/1979 | Chiba | 124/70 |
| 4,819,609 | 4/1989 | Tippmann | 124/72 |
| 4,850,330 | 7/1989 | Nagayoshi | 124/76 |
| 4,892,081 | 1/1990 | Moormann | 124/65 |
| 4,951,644 | 8/1990 | Bon | 124/75 |
| 5,063,905 | 11/1991 | Farrell | 124/72 |
| 5,113,842 | 5/1992 | Moormann | 124/65 |
| 5,115,794 | 5/1992 | Moormann | 124/65 |

*Primary Examiner*—Randolph A. Reese
*Assistant Examiner*—John Ricci
*Attorney, Agent, or Firm*—Roy A. Ekstrand

[57] ABSTRACT

A rapid fire ball gun includes a hollow body supporting a pressurizable air vessel and an air pump coupled thereto through a check valve. An elongated cylindrical barrel is supported by the body and defines a cylindrical ball chamber having a plurality of spaced intermediate fields forming ball spaces therebetween and a final seal at the extending end of the cylindrical barrel. A plurality of compressible foam balls are received within the ball spaces between the intermediate seals with the outermost ball being received in a ball spaced defined between the final seal and the most forward intermediate seal. The cylindrical barrel is coupled to the pressurizable air vessel by a trigger valve mechanism which responds to trigger pressure by coupling the pressurized air within the air vessel to the barrel thereby expelling one or more of the compressible foam balls from the barrel.

10 Claims, 1 Drawing Sheet 10
11
12
13
14
15
20
21
22
23
24
25
26
27
30
31
32
33
40
41
42
43
44
45
50
51
52
53
54
55
56
57
58
60
61
62
70
71
72
73
74
75
76
80
81
82
83
84
85
86
90
91
92
93
94

11
15
31
70
71
72
73
74
75
76
80
81
82
83
84
85
86
90
91
92
93
94

11
15
31
70
71
72
73
74
75
76
80
81
82
83
84
85
86
90
91
92
93
94

RAPID FIRE BALL GUN

FIELD OF THE INVENTION

This invention relates generally to ball firing guns and particularly to those having multiple fire capability.

BACKGROUND OF THE INVENTION

A great variety of toy guns for shooting and launching light balls and other projectiles have been provided for many years. Originally, such guns fired ping-pong balls utilized for their light harmless characteristic. Later, such guns also fired solid foam balls having compressible foam bodies. In most such projectile firing guns, air pressure within an air pressure chamber or barrel is utilized to eject the projectile. With the continuing popularity of such toy guns, the practitioners in the art have provided a great number of designs and configurations.

For example, U.S. Pat. No. 4,159,705 issued to Jacoby sets forth a Toy Projectile Launching Device in which a miniaturized cannon defines a barrel, a breach portion and an expandable air pressure reservoir such as a balloon. A valve within the breach portion is operative in response to a squeeze bulb air pump to alternatively inflate the balloon reservoir or open the breach valve and launch a projectile within the barrel portion.

U.S. Pat. No. 4,086,902 issued to Reynolds sets forth Toy Projectile Launching Apparatuses in which a toy is configured to simulate a small machine gun or similar weapon having an upwardly extending magazine portion. An elongated barrel is in communication with the magazine portion and a plurality of projectiles are stacked within the magazine such that the bottommost projectile is aligned with the barrel. An air operated plunger is coupled to a hand operated bellows by a hollow tube. The sudden compression of the air bellows forces the plunger to extend into the barrel and thrust the bottommost projectile outwardly from the magazine through the barrel.

U.S. Pat. No. 5,113,842 issued to Moormann sets forth a Rapid Fire Ball Launcher in which an elongated hollow cylindrical barrel defines a rigid constriction at its outer end and a movable plunger at the remaining end. A spring-biased carriage forces a plurality of soft foam balls against the front constriction in a sealing engagement. The rapid movement of the plunger produces pressurized air within the ball chamber ejecting the frontmost ball. Thereafter, the spring and carriage cooperate to force the next successive ball against the front constriction.

U.S. Pat. Nos. 4,892,081 and 5,115,794 both issued to Moormann set forth a Compressible Ball Launcher for launching a soft closed cell compressible foam ball. A cylindrical chamber supports a movable air plunger and is coupled to an enlarged ball chamber having a forward constriction formed at the outer portion thereof. The ball chamber receives a soft foam ball which is ejected from the ball chamber by air pressure produced by rapid plunger movement.

U.S. Pat. No. 2,601,555 issued to Pope sets forth a Repeating Toy Gun for firing projectiles such as tennis balls from a multiple ball magazine. Air pressure means are provided for firing the topmost or forwardmost ball within the magazine.

U.S. Pat. No. 2,630,108 issued to White sets forth an Repeating Air Pressure Gun having an elongated cylindrical barrel defining a front constriction and a spring biasing mechanism for receiving a plurality of to-be-fired balls. The spring mechanism forces the forwardmost ball against the front constriction. An air plunger is coupled to a slidably supported handle and stock portion which is moved rapidly to draw air into the ball cylinder and thereafter fire the frontmost ball.

U.S. Pat. No. 2,653,593 issued to Foster sets forth a Repeating Air Gun having an elongated cylindrical barrel and an extending curved portion formed in continuation therewith within the handle and stock portion of the gun. A plurality of to-be-fired ball projectiles are supported within the extended length chamber and spring-biasing means are provided for forcing the frontmost ball against a resilient seal. Air pressure is utilized to expel the forwardmost ball.

U.S. Pat. No. 2,725,868 issued to Foster sets forth an Air Gun configured in the same general manner as the above-described U.S. Pat. No. 2,653,593 with the addition of an improved biasing mechanism.

U.S. Pat. No. 2,725,869 issued to Barber sets forth a Magazine Toy Gun having an elongated cylindrical barrel and a spring-biasing mechanism for receiving and supporting a plurality of to-be-fired ball projectiles. A front seal restrains the forwardmost ball. A spring loaded trigger mechanism is coupled to a movable air plunger and is utilized to abruptly pressurize the ball chamber and eject the forwardmost ball.

U.S. Pat. No. 2,729,207 issued to Foster sets forth a Repeater Air Gun generally configured to resemble a pump style shotgun includes an elongated cylindrical barrel for receiving a plurality of to-be-fired ball projectiles and having a front seal disposed therein. A pump mechanism produces pressurized air within the barrel to launch the forwardmost ball.

U.S. Pat. No. 2,749,902 issued to Foster sets forth a Repeating Air Gun having a pair of telescoping cylindrical hollow portions each coupled to a separate handle. A plurality of to-be-fired ball projectiles are received within the innermost cylindrical member and restrained by a front seal. A rapid closure movement between the two handles pressurizes the air within the ball chamber forcing the frontmost ball outwardly from the chamber.

U.S. Pat. No. 2,762,356 issued to Foster sets forth a Repeating Air Gun having a configuration generally conforming to a pump style shotgun. A movable slide member is coupled to an air pump within the stock and handle portion of the gun. An elongated cylindrical barrel is coupled to the pump chamber and includes a plurality of to-be-fired balls and a front constriction. As the slide pump is moved quickly, air pressure is produced within the slide pump which is communicated to the ball chamber causing the forwardmost ball to be fired.

U.S. Pat. No. 2,762,357 issued to Foster sets forth an Repeating Air Rifle having a structure generally similar to that set forth in the above-described U.S. Pat. No. 2,653,593.

U.S. Pat. No. 3,342,171 issued to Ryan, et al. sets forth a Toy Pop Gun having an Air Pump with a Resiliently Flexible Movable Chamber Closure Member in which a chamber and pump cooperate to compress the air within the chamber. The chamber has an outlet and piston-like member having a resilient periphery sealing the opening to retain air pressure. Trigger means hold the piston-like member in a sealing position until trigger actuation which permits the pressure in the chamber to force the pop member out and produce a firing sound.

U.S. Pat. No. 3,765,396 issued Kienholtz, et al. sets forth Air Guns having a pair of telescoping elongated cylindrical members each having a separate handle portion. A plurality of to-be-fired ball projectiles are received within the innermost cylinder and restrained by a forward restriction. A pump mechanism is provided between the inner and outer cylindrical members which produces compressed air within the inner member as the handles are rapidly brought to closure.

While the foregoing described prior art devices have, in many instances, improved the state of the art for such ball launching toys and toy guns, there remains nonetheless a continuing need in the art for evermore improved ball guns.

SUMMARY OF THE INVENTION

Accordingly, it is a general object of the present invention to provide an improved ball gun. It is a more particular object of the present invention to provide an improved ball gun having a flexible rapid fire capability.

In accordance with the present invention, there is provided a ball gun for firing a plurality of ball projectiles, said ball gun comprises: a body; an air vessel supported by the body; a barrel supported by the body and defining a generally cylindrical ball chamber having an inner end, an outer end, a plurality of spaced apart intermediate seal constrictions and a final seal constriction proximate the outer end; means for pressurizing the air vessel; and trigger means, actuatable by the user, for selectively coupling the air vessel to the inner end of the ball chamber, the barrel chamber receiving a plurality of ball projectiles between the intermediate seal constriction and between the final seal constriction and its most proximate intermediate seal constriction.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
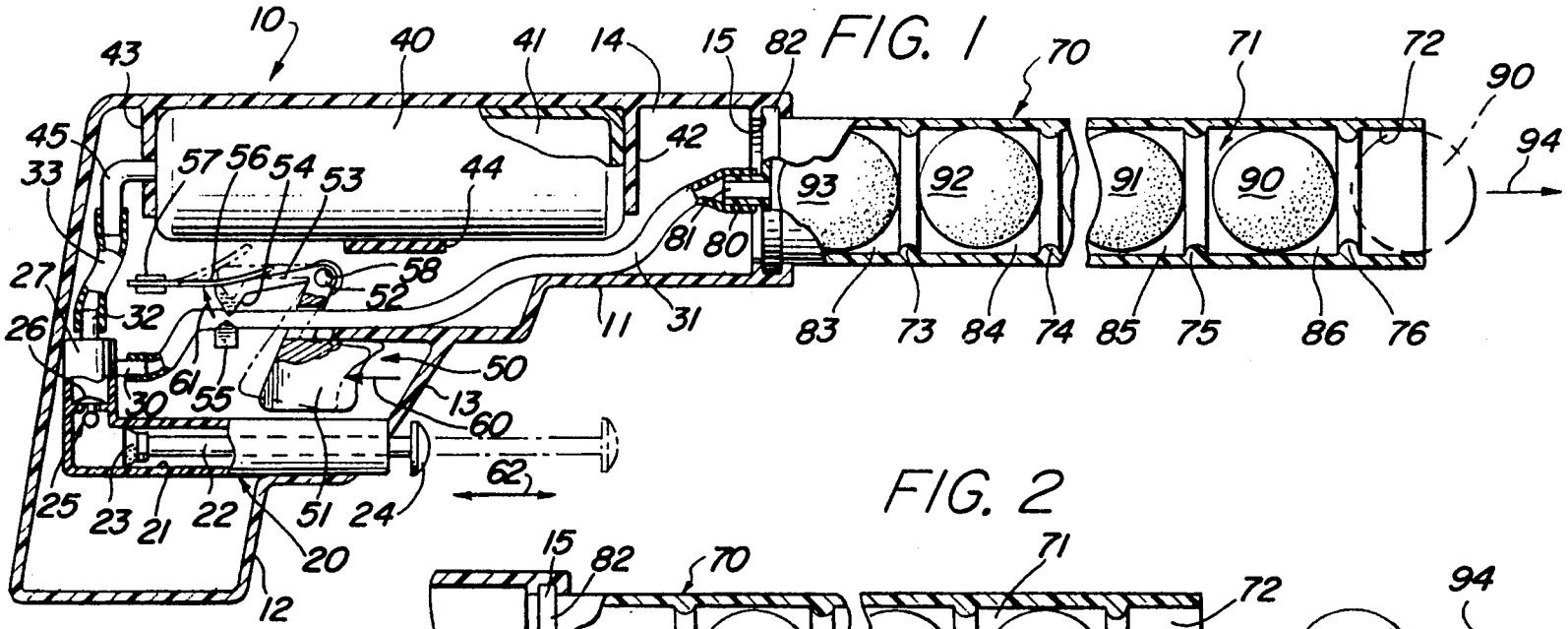
FIG. 1 sets forth a section view of a rapid fire ball gun constructed in accordance with the present invention.

FIG. 1 sets forth a section view of a rapid fire ball gun constructed in accordance with the present invention and generally referenced by numeral 10. Ball gun 10 includes a body 11 preferably formed of molded plastic material or the like and comprising, in its preferred form, a pair of mating half portions in accordance with general fabrication techniques. Body 11 is hollow defining an interior cavity 14, a trigger guard 13 and a handle portion 12. Within interior cavity 14, body 11 further defines a plurality of air vessel support members 42, 43 and 44.

Air gun 10 further includes an internally supported air pump 20 having a pump cylinder 21 within which a piston rod 22 is movably supported. Piston rod 22 extends outwardly from pump cylinder 21 and beyond air gun body 11 terminating in a knob 24. The interior end of piston rod 22 supports a piston seal 23. Piston rod 22 is movable within pump cylinder 21 back and forth in the direction indicated by arrows 62. Air pump 20 further includes a check valve 25 having a resilient valve seal 26 movably supported therein. An air plenum 27 having a pair of air couplings 30 and 32 is formed beyond check valve 25.

An air vessel 40 having a generally cylindrical configuration and defining a sealed interior chamber 41 wherein is received within interior cavity 14 of body 11 and is supported by support members 42 through 44. Air vessel 40 further includes a coupling member 45 in communication with interior chamber 41. A flexible hollow tube 33 extends between coupling members 32 and 45 to provide communication between air pump 20 and air vessel 40.

An elongated generally cylindrical barrel 70 defines an outwardly extending lip 82 which is received within groove 15 formed in body 11 to secure barrel 70 to body 11. Barrel 70 further defines a coupling 80 having an air passage 81 therein. A plurality of generally annular inwardly extending intermediate fields 73, 74 and 75 are formed in a generally evenly spaced arrangement within the interior of ball chamber 71. A final seal 76 extends inwardly within ball chamber 71 and is preferably formed to have a greater inward extension than that formed by intermediate seals 73 through 75. In its preferred form, intermediate seals 73 through 75 and final seal 76 are generally evenly spaced to define intervening ball receiving spaces 83 through 86. A plurality of spherical ball projectiles 90 through 93 are received within the spaces between seals 73 through 76. In their preferred form, balls 80 through 93 are formed of a compressible resilient foam cell material and define diameters less than that of ball chamber 71 but greater than the inner diameters of seals 73 through 76. Barrel 70 further defines a muzzle portion 72 extending beyond final seal 76.

A flexible hollow tube 31 is coupled between coupling 80 of barrel 70 and coupling 30 of plenum 27. A trigger mechanism generally referenced by numeral 50 includes a pivot support 52 secured to the interior of interior cavity 14 of body 11 together with a movable trigger button 51. Trigger button 51 further includes a pinch arm 53 and an aperture 58. Aperture 58 is received upon pivot 52 and permits the pivotal motion of trigger button 51 and pinch arm 53. Pinch arm 53 terminates in a wedge-shaped member 54 extending toward tube 31. A stationary wedge 55 is supported within interior cavity 14 of body 11 and faces upwardly on the remaining side of flexible tube 31. Thus, flexible tube 31 passes between the inwardly facing pair of pinch wedges formed by wedges 54 and 55. A spring support 57 also formed and supported within interior cavity 14 supports an elongated beam spring 56. Beam spring 56 is coupled to pinch arm 53 and urges pinch arm 53 in a counterclockwise direction of rotation about pivot 52. Thus, the spring force of spring 56 forces wedge 54 against tube 31 and wedge 55 to provide a pinching closure of tube 31. Trigger mechanism 50 is actuated by the user's pressing of trigger button 51 in the direction indicated by arrow 60 which in turn causes a pivotal rotation of pinch arm 53 in the direction indicated by arrow 61 thereby releasing the pinching closure of tube 31 and placing plenum 27 in communication with ball chamber 71 of barrel 70.

In operation, a plurality of foam balls 90 through 93 are loaded within intermediate spaces 83 through 86 in the manner shown in FIG. 1 by simply forcing balls 90 through 93 past final seal 76 and intermediate seal 75, 74 and 73. With balls 90 through 93 thus loaded, the user then actuates air pump 20 by moving knob 24 and piston rod 22 back and forth in the directions indicated by arrows 62. Each forward stroke of piston rod 22 drives piston seal 23 toward check valve 25 pressurizing the air captivated therebetween and forcing check valve 25 open. With trigger button 51 released, trigger mechanism 50 maintains closure of tube 31 due to the pinching action of wedges 54 and 55. Thus, the pressurized air within air pump 20 is forced through check valve 25, coupling 32, tube 33 and coupling 45 into interior chamber 41 of air vessel 40. This process is repeated until air vessel 40 is properly pressurized and a quantity of pressurized air is stored within interior chamber 41. Check valve 25 precludes the release of air pressure from air vessel 40 by closing in the absence of operation of air pump 20.

At this point, air gun 10 is loaded and ready for firing. The user fires air gun 10 by simply depressing trigger button 51 which pivots pinch arm 53 against spring 56 separating wedge portions 54 and 55. The separation of wedges 54 and 55 opens the air coupling between plenum 27 and ball chamber 71 of barrel 70. In response, the pressurized air within air vessel 40 flows outwardly through coupling 45, tube 33, coupling 32, plenum 27, coupling 30, tube 31 and coupling 80 to ball chamber 71. The introduction of pressurized air within ball chamber 71 moves balls 90 through 93 forwardly toward muzzle 72. Thus, ball 93 is moved forwardly against intermediate seal 73, ball 92 is moved forwardly against intermediate seal 73, ball 92 is moved forwardly against intermediate seal 74, ball 91 is moved forwardly against seal 75 and ball 90 is moved forwardly against final seal 76. As the flow of pressurized air into ball chamber 71 continues, the pressure therein continues to increase causing balls 91, 92 and 93 to be forced through intermediate seals 75, 74 and 73 respectively all of which are forced against ball 90 within space 86 which is restrained by final seal 76. As mentioned above, in its preferred form, final seal 76 extends inwardly a greater distance than intermediate seal 73 through 75. Thus, final seal 76 provides a substantially greater restraint for ball 90 than is provided by intermediate seals 73 through 75 for balls 91, 92 and 93. The continued application of air pressure from vessel 40 builds up against balls 90 through 93 until sufficient force is exerted upon ball 90 to force it past final seal 76 and outwardly through muzzle 72. Ball 90 is duplicated in dashed-line representation in FIG. 1 during the moment following this firing or launch during which time ball 90 has passed through final seal 76 and is moving outwardly in the direction indicated by arrow 94 through muzzle 72. The operation of muzzle 72 permits the continued application of pressurized air from ball chamber 71 being expelled outwardly through muzzle 72 to provide an additional launching force against ball 90 as it traverses muzzle 72. Thus, a substantial increase in the launching force against ball 90 is provided by muzzle 72. The length of muzzle 72 may be selected in accordance with the user's needs to suit the degree of additional force desired.

Once the outermost ball is forced past final seal 76 (ball 90 in this instance) the succeeding balls within ball chamber 71 are easily forced past their respective intermediate fields thereby causing each ball to move sequentially to the next available ball space. Thus, following the firing of ball 90, ball 91 moves to the position shown for ball 90 within space 86 while balls 92 and 93 move to spaces 85 and 84 respectively.

In accordance with an important aspect of the present invention, the user may control the operation of air gun 10 by manipulation of trigger button 51 to selectively fire a single ball projectile or series of projectiles on a one by one basis or, alternatively, may elect to squeeze trigger button 51 inwardly and hold it causing a rapid fire action in which all of the balls within barrel 70 are expelled in the manner described below.

Figure 2:
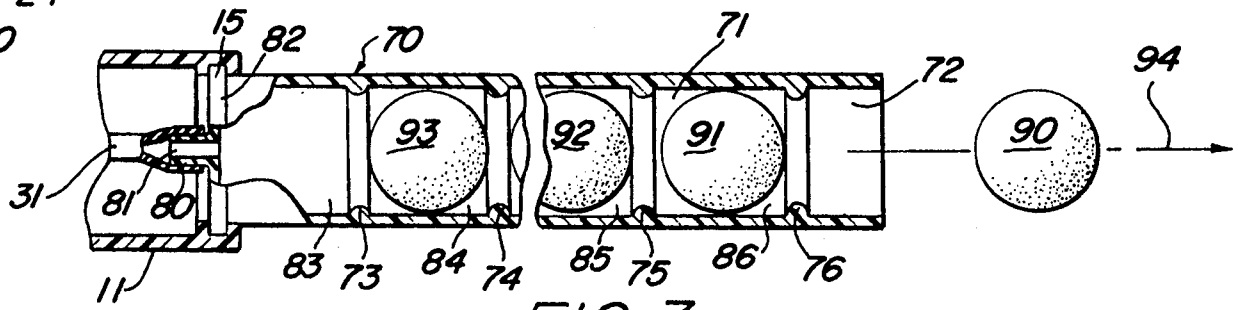
FIG. 2 sets forth a partial section view of the present invention rapid fire ball gun during single shot operation.
Figure 3:
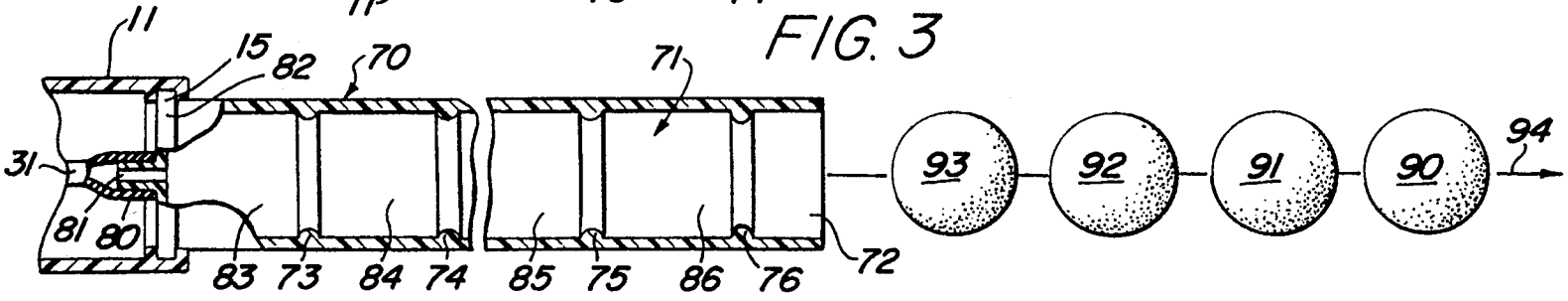
FIG. 3 sets forth a partial section view of the present invention rapid fire ball gun during rapid fire action.

FIGS. 2 and 3 set forth partial section views showing the operation of the present invention air gun in response to brief trigger button action causing single shot firing and response in a rapid fire mode using extended trigger button depression to expel all of the ball projectiles in a single dramatic burst.

More specifically, FIG. 2 sets forth a partial section view of barrel 70 supported within body 11 in the manner described above. Body 11 defines a groove 15 while barrel 70 defines a cooperating lip 82 which is received therein. Barrel 70, as is also described above, defines a generally cylindrical barrel having an interior ball chamber 71 and an air coupling 80. Tube 31 couples coupling 80 to plenum chamber 27 (seen in FIG. 1). As is also described above, barrel 70 defines inwardly extending intermediate seals 73, 74 and 75 together with a final seal 76. Muzzle 72 extends beyond final seal 76 and a plurality of ball spaces 83 through 86 are formed behind seals 73 through 76 respectively. In the position shown in FIG. 2, the above-described firing action has taken place in response to the user having briefly squeezed trigger button 51 to provide a short duration air burst within ball chamber 71 of barrel 70. In response to the above-described mode, ball 90 has been expelled outwardly from muzzle 72 and is shown projected in the direction of arrow 94. The ejection of ball 90 releases the air seal between ball 90 and final seal 76 which in turn releases the pressurized air within ball chamber 71. So long as trigger button 51 has been released at this point, balls 91 through 93 have been moved to spaces 86, 85 and 84 respectively but will not be removed against final seal 76 and intermediate seals 75 and 74 due to the absence of air pressure. Thus, the proper manipulation of trigger button 51 by the user produces air bursts of sufficient duration to fire and eject the forwardmost ball in a single shot operation. During this process, the use of intermediate seals within barrel 70 facilitates this single shot capability. The interruption of ball movement provided by the intermediate seals provides sufficient restraining force to prevent the inadvertent and uncontrolled firing of more than one ball. It has been found that the user quickly adjusts to and learns the necessary optimum trigger manipulation to provide effective single shot firing of the present invention air gun.

FIG. 3 sets forth the response to air gun 10 which occurs when the user undertakes a rapid fire operation. As mentioned above, the user implements a rapid fire operation by simply squeezing and holding trigger button 51. As trigger button 51 remains depressed, a continuous stream of pressurized air is applied to ball chamber 71. In response to continuous pressurized air within ball chamber 71, the forwardmost ball is forced past final seal 76 and each successive ball is moved into the next ball space past the next intermediate seal. Once the forwardmost ball has been forced outwardly past final seal 76 and muzzle 72, the continued presence of air pressure provided within barrel chamber 71 by air vessel 40 moves the remaining balls within ball chamber 71 forwardly against the next seal. This forces the forwardmost ball against final seal 76 replacing the previously fired ball and again forming a seal which is overcome by the air pressure and forces the forwardmost ball outwardly to continue the process. This process repeats until the last ball within ball chamber 71 is expelled forming a series of projected balls in the manner shown in FIG. 3 all travelling in the direction indicated by arrow 94.

Thus, in accordance with an important aspect of the present invention, the use of intermediate seals within the cylindrical ball chamber provides the capability to either fire a repeating single shot series of balls or expel all the balls within the ball chamber in a rapid fire burst. It should be apparent to those skilled in the art that the length of barrel 70 and the number of intermediate seals and the number of balls utilized within barrel 70 may be varied to provide a greater or lesser number of to-be-fired balls within air gun 10. The air gun shown is capable of substantial flexibility and use as the user quickly learns to manipulate the trigger button with sufficient skill to expel one or more balls as desired.

It will be apparent to those skilled in the art that while the embodiment of the present invention set forth above is configured to fire compressible type balls and thus the intermediate seals and final seal formed within the barrel chamber are generally rigid, the present invention may also be practiced utilizing balls which are generally not compressible such as ping-pong balls or the like in which case the intermediate and final seals are formed of a resilient material to provide the cooperating seal between the generally incompressible ball in this event. It will be recognized by those skilled in the art that the present invention intermediate and final seal configuration should be understood to embrace and include such variations.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A ball gun for firing a plurality of ball projectiles, said ball gun comprising:

a body;

an air vessel supported by said body;

a barrel supported by said body and defining a generally cylindrical ball chamber having an inner end, an outer end, a plurality of spaced apart intermediate seal constrictions and a final seal constriction proximate said outer end;

means for pressurizing said air vessel; and trigger means, actuatable by said user, for selectively coupling said air vessel to said inner end of said ball chamber, said barrel chamber receiving a plurality of ball projectiles between said intermediate seal constrictions and between said final seal constriction and its most proximate intermediate seal constriction.

2. A ball gun as set forth in claim 1 wherein said means for pressurizing includes:

an air pump; and a check valve coupling said air pump to said air vessel.

3. A ball gun as set forth in claim 2 wherein said barrel further defines a generally cylindrical muzzle portion extending beyond said final seal constriction.

4. A ball gun as set forth in claim 3 wherein said trigger means includes a trigger actuating button and a valve operated by said trigger actuating button coupling said air vessel to said ball chamber.

5. A ball gun as set forth in claim 4 wherein said final seal constriction defines an inner diameter less than those of said intermediate seal constrictions.

6. A ball gun as set forth in claim 5 wherein said intermediate and final seal constrictions are generally rigid.

7. A ball gun for shooting a plurality of ball projectiles comprising:

a barrel defining a generally cylindrical ball chamber having first and second ends and a diameter at least as large as said ball projectiles and defining a plurality of generally annular inwardly extending intermediate seal constrictions and a generally annular inwardly extending final seal constriction proximate said second end; and air pressure means coupled to said first end of said ball chamber for applying air pressure thereto for a selected time interval to expel one or more ball projectiles outwardly from said second end.

8. A ball gun as set forth in claim 7 wherein said barrel further defines a muzzle portion having a diameter approximately equal to that of said ball chamber extending from said final seal constriction to said second end.

9. A ball gun as set forth in claim 8 wherein said ball projectiles are compressible and wherein said seal constrictions are generally rigid.

10. A ball gun as set forth in claim 9 wherein said final seal constriction defines a smaller inner diameter than said intermediate seal constrictions.

* * * * *